US005685102A

United States Patent [19]

Latka

[11] Patent Number: 5,685,102

[45] Date of Patent: Nov. 11, 1997

[54] SNAP-ON FIREARM ADAPTER

[75] Inventor: Gregory S. Latka, Jackson, Mich.

[73] Assignee: GSL Technology, Inc., Jackson, Mich.

[21] Appl. No.: 560,983

[22] Filed: Nov. 20, 1995

[51] Int. Cl.[6] ..... F41C 27/00

[52] U.S. Cl. ..... 42/85; 42/90; 42/76.01; 89/14.05

[58] Field of Search ..... 42/79, 85, 86, 42/90, 93, 97; 89/14.5, 14.05, 14.4, 14.3, 14.2

[56] References Cited

U.S. PATENT DOCUMENTS

| | | | |
|---|---|---|---|
| 2,092,649 | 9/1937 | Jung | 42/79 |
| 3,187,632 | 6/1965 | Harvey | 89/14.05 |
| 3,672,254 | 6/1972 | Travor et al. | 89/1.11 |
| 4,047,779 | 9/1977 | Klancnik | 439/304 |
| 4,268,897 | 5/1981 | Cash | 42/106 |
| 4,296,914 | 10/1981 | Allread | 251/149.2 |
| 4,480,668 | 11/1984 | Lin | 145/63 |
| 4,893,426 | 1/1990 | Bixler | 42/75.01 |
| 4,922,640 | 5/1990 | Toombs | 42/16 |
| 5,123,446 | 6/1992 | Haunhorst et al. | 137/614.02 |
| 5,433,133 | 7/1995 | LaFrance | 89/14.2 |
| 5,509,345 | 4/1996 | Cyktich | 89/14.05 |

*Primary Examiner*—Michael J. Carone
*Assistant Examiner*—Christopher K. Montgomery
*Attorney, Agent, or Firm*—Duncan F. Beaman

[57] ABSTRACT

A snap-on coupling for mounting accessories on the end of a cylindrical gun barrel characterized by its ability to be quickly operated. The gun barrel is provided with an annular groove axially spaced from the gun barrel end, and an adapter includes a bore receiving the gun barrel end region and radially displaceable ball detents in the adapter are received within the barrel groove upon radial alignment. A spring biased detent operator collar axially displaceably mounted on the adapter controls the radial position of the ball detents wherein manual axial displacement of the detent operating collar may be accomplished quickly with one hand. In an embodiment of the invention, a ball detent retainer sleeve within the adapter bore is automatically displaced by the gun barrel end upon placing the adapter on the gun barrel permitting the ball detents to be received within the barrel groove upon alignment, and the ball retainer sleeve eliminates the necessity of displacing the collar during insertion of the adapter on the gun barrel.

6 Claims, 2 Drawing Sheets

SNAP-ON FIREARM ADAPTER

BACKGROUND OF THE INVENTION

1. Field of the Invention

The invention pertains to a snap-on type coupling for mounting a firearm accessory adapter upon a gun barrel characterized by its ability to quickly mount and remove the adapter, produce a positive effective mechanical lock of the adapter on the gun barrel, provide a predetermined rotational relationship between the adapter and the gun barrel, and in an embodiment, permit the adapter to be locked upon the gun barrel merely by producing a relative axial movement between the gun barrel and adapter.

2. Description of the Related Art

It is often desirable to mount an accessory such as a flash suppressor, silencer, grenade launcher, blank adapter, or the like, upon the end of gun barrels. Such accessories are usually mounted upon an adapter which constitutes a coupling for attaching the accessory to the gun barrel. This invention particularly pertains to gun barrels whose end region is of a cylindrical configuration, and the invention may be utilized with a wide variety of firearms having cylindrical gun barrels.

It is known to utilize firearm accessory adapters which employ bayonet type connections on the adapter which associate with lugs formed on the gun barrel. Firearm accessory adapters of this type are shown in U.S. Pat. Nos. 4,893,426 and 5,433,133. However, the majority of gun barrels are of a cylindrical configuration adjacent the end region and do not include lugs, and the concepts of the invention are particularly suitable for use with gun barrels of this type. The coupling construction between the gun barrel and the adapter is such that the adapter may be quickly and readily mounted upon the gun barrel by an unskilled operator, and the adapter of the invention is capable of quick mounting and release from the gun barrel while permitting a predetermined rotational relationship of the adapter on the barrel.

OBJECTS OF THE INVENTION

It is an object of the invention to provide a coupling for a firearm accessory adapter which may be quickly mounted upon a gun barrel having a cylindrical end region wherein the gun barrel requires only minimal modification and axial one hand movement is required to mount and lock the adapter on the barrel and also remove the adapter therefrom.

Another object of the invention is to provide a coupling arrangement for a firearm accessory adapter wherein a cylindrial gun barrel end region includes an annular groove axially spaced from the gun barrel end, and the adapter includes a plurality of ball detents radially displaced by a spring biased axially displaceable cam collar wherein the adapter may be easily mounted upon the end of the gun barrel by one hand operation when the detent balls are released and capable of clearing the adapter bore, and when the detent balls are in alignment with the barrel groove, the cam collar will force the detent balls into the barrel groove to lock the adapter on the barrel in a manner which resists inadvertent disconnection due to vibration.

Yet another object of the invention is to provide a coupling for a firearm accessory adapter utilizing an annular groove defined on the cylindrical gun barrel and radially displaceable detent balls receivable within the groove wherein the groove contains recesses for receiving the detent balls whereby the reception of the detent balls in the recesses prevents relative radial displacement between the adapter and the gun barrel, and in an embodiment of the invention, the recesses are located circumferentially within the groove in an asymmetrical manner corresponding to the asymmetrical location of the detent balls in the adapter wherein the adapter can only be locked upon the gun barrel in a single rotative position.

A further object of the invention is to provide a coupling for a firearm accessory adapter usable with a cylindrical gun barrel having an annular groove defined therein wherein radially displaceable ball detents operated by a cam collar axially displaceable under a spring force upon the adapter, and the adapter bore including a detent ball retainer sleeve spring biased in a direction to normally maintain the detent balls removed from the adapter bore whereby insertion of the adapter upon the gun barrel causes the end of the gun barrel to displace the detent ball retainer sleeve permitting the detent balls to automatically extend into the barrel groove upon radial alignment therewith simplifying mounting of the adapter, and yet the ball retainer sleeve still permits one hand axial displacement of the cam collar to release the detent balls and remove the adapter from the gun barrel.

SUMMARY OF THE INVENTION

The adapter coupling of the invention is for use with gun barrels of a cylindrical configuration wherein an annular groove is defined in the gun barrel axially spaced from the gun barrel end. This axial groove may be formed in the gun barrel during gun barrel manufacture, or may be retro machined into the gun barrel upon disassembly of the gun barrel from the other firearm mechanism.

The accessory adapter includes a cylindrical bore of a diameter slightly greater than the diameter of the gun barrel cylindrical surface wherein the gun barrel may be closely inserted into the adapter bore. The adapter includes exterior threads upon which the accessory may be threaded, as is known, and the adapter body is provided with a plurality of radial holes each receiving a ball detent for radial displacement therein. The balls are prevented from excessive inward displacement by an annular lip defined in the adapter holes, and outward radial movement of the detent balls is limited by an annular cam collar axially displaceable upon the adapter biased by a compression spring in a direction wherein an annular cam formed upon the collar radially inwardly deflects the detent balls, and a cylindrical surface within the collar retains the detents in their inner position during mounting of the adapter on the gun barrel.

The collar includes a clearance adjacent the cam surface which, by axially displacing the cam collar on the adapter in a direction to compress the spring, permits the radial balls to move outwardly as the gun barrel is inserted into the adapter bore. Once the detent holes are radially aligned with the gun barrel groove, the collar cam will force the detent balls into the groove permitting the ball retaining surface defined on the collar to hold the balls within the barrel groove thereby locking the adapter on the gun barrel preventing relative axial displacement therebetween.

Recesses may be circumferentially defined within the gun barrel groove for receiving the detents wherein the cam collar is not able to be fully displaced to its ball retaining position until the balls are received within the groove recesses. In this manner, reception of the ball detents within the recesses will lock the adapter and gun barrel against relative rotative movement as well as preventing relative axial displacement.

By asymmetrically locating the groove recesses, and complementarily circumferentially locating the ball detents on the adapter, it is possible to use the ball detents and groove recesses to rotatively position the adapter to the gun barrel in a single predetermined relationship.

It is further contemplated that relative rotation between the gun barrel and adapter can be prevented by utilizing cooperating tongue and groove type key members defined on the gun barrel structure and the adapter which only permit the gun barrel to be inserted into the adapter sufficiently to radially align the detent balls and groove when the gun barrel and adapter are in a predetermined rotative relationship permitting the tongue to enter the groove.

The adapter may be quickly removed from the gun barrel by one hand merely by grasping the cam collar and displacing the same on the adapter in a direction to compress the spring. Sufficient displacement of the collar will permit the ball detents to radially move in an outward direction releasing the adapter from the gun barrel.

In another embodiment of the inventive concepts, a ball retainer sleeve is located within the adapter bore and is axially displaceable therein. A compression spring biases the sleeve in a direction permitting an annular retaining surface defined on the sleeve to engage the detent balls and hold the detent balls in an outward radial position wherein the ball detents will be held clear of the adapter bore.

The ball detent retainer sleeve is biased in a direction toward the end of the adapter receiving the gun barrel. Upon insertion of the gun barrel into the adapter bore, the barrel end engages the facing sleeve end and the sleeve spring is compressed, the ball detents will ride along the cylindrical barrel end region until radially aligned with the gun barrel groove, and upon alignment, the inward radial force imposed upon the ball detents by the collar cam will automatically force the balls into the barrel groove permitting the cam sleeve to extend its maximum distance locating the ball retainer surface aligned with the balls and maintaining the balls within the barrel groove thereby locking the adapter to the gun barrel. This embodiment eliminates the necessity to retract the cam collar prior to placing the adapter upon the gun barrel.

In the aforedescribed embodiment, removal of the adapter from the gun barrel is accomplished identically to the first described embodiment wherein the cam collar is axially displaced to compress its spring aligning the collar detent clearance with the detents permitting the balls to ride out of the groove and the adapter removed from the gun barrel. As the gun barrel and adapter are axially displaced, the engagement of the end of the sleeve with the end of the gun barrel will automatically permit the sleeve detent retainer surface to slide under the ball detents to retain them in the retracted position in preparation of the next mounting of the adapter on the gun barrel.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
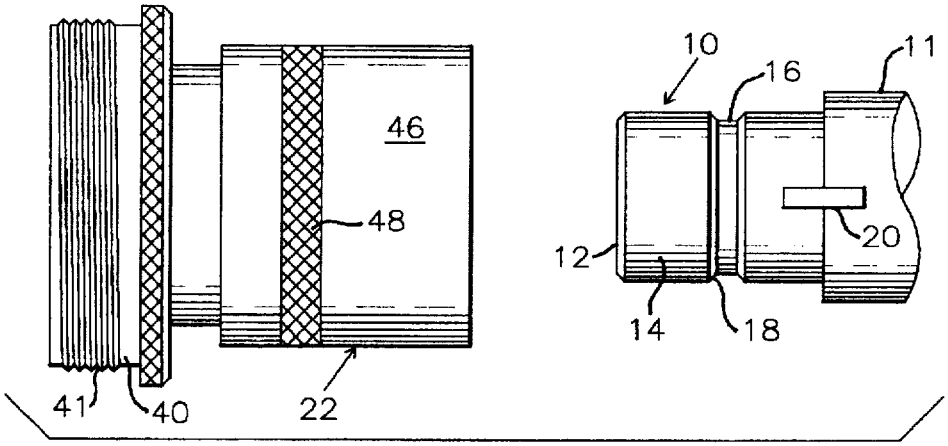
FIG. 1 is an elevational view of a gun barrel and adapter in accord with the invention upon being axially aligned, and prior to the adapter being mounted upon the gun barrel.

As shown in FIG. 1, a gun barrel having a cylindrical configuration is represented at 10 having an end 12 intersected by the gun barrel bore 13. The gun barrel 10 includes the cylindrical end region 14, and an annular groove 16 is defined about the gun barrel axially spaced from the end 12. The groove 16 includes chamfered sides 18.

An axially extending key 20 may be mounted upon the firearm structure 11 for a purpose which will later be apparent.

Figure 2:
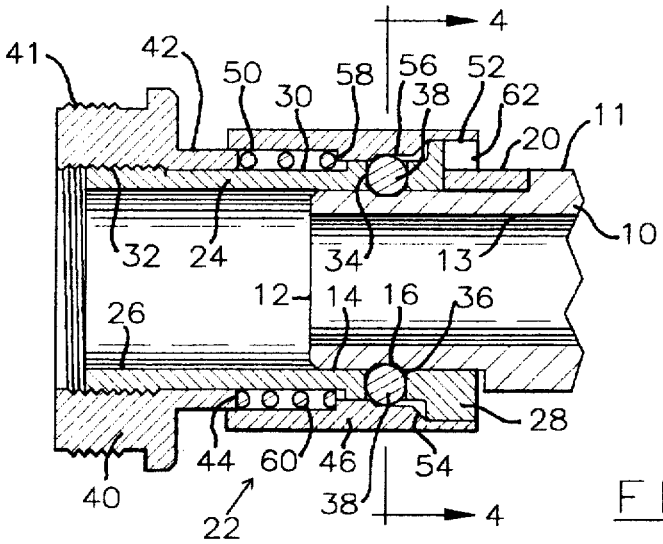
FIG. 2 is a diametrical sectional view of the adapter and gun barrel upon the adapter being fully mounted and locked upon the gun barrel.

The firearm accessory adapter is generally indicated at 22 and includes an annular body 24 having a cylindrical bore 26 of a diameter slightly greater than the diameter of the gun barrel end region 14 so as to slidably receive the gun barrel as illustrated in FIG. 2. The body 24 also includes an enlarged cylindrical boss 28 at one end, and the cylindrical surface 30 is provided with threads 32 at its end. A plurality of radially extending cylindrical detent holes 34 are circumferentially spaced about the body 24, and, usually, the detent holes 34 are uniformly spaced from each other about the adapter body. Each detent hole innermost end is provided with an annular lip 36 which limits the inward movement of the ball detents 38 received within the holes 34. As will be later appreciated, the ball detents 38 are capable of limited radial displacement within the holes 34.

The accessory mount 40 threads upon the threads 32 and includes threads 41 upon which the accessory such as the flash suppressor, silencer, etc., not shown, is threadably mounted. The accessory mount 40 also includes an annular skirt 42 which defines the radial shoulder 44.

An annular cam collar 46 is reciprocally axially displaceable upon the body 24 and is externally knurled at 48 to facilitate manual operation. The collar 46 is internally annularly recessed at 50, and at its outer end is provided with an annular ball clearance surface 52. The annular oblique cam surface 54 intersects clearance surface 52 and the cylindrical detent retainer surface 56. A radial shoulder 58 is defined on the cam collar 46 and a compression spring 60 located between the body surface 30 and the collar recess 50 engages the accessory mount shoulder 44 and the collar shoulder 58 to bias the cam collar toward the right, FIG. 2. A key recess 62 complementary in configuration to the key extension 22 is defined in the end of the body boss 28 for cooperation with the key 20 as later described.

To mount the adapter 22 upon the gun barrel 10, the parts will be aligned as shown in FIG. 1. The operator places the barrel end region 14 within the adapter bore 26, and the barrel 10 may be inserted into the adapter bore until the chamfered barrel end 12 engages the ball detents 38. At this time, the ball detents will be held in their innermost radial position, such as that shown in FIG. 2, by the cam collar surface 56.

Upon the ball detents 38 engaging the barrel end 12, the operator grasps the cam collar 46 at the knurl 48 and axially moves the collar toward the accessory mount 40. This displacement of the collar compresses the spring 60, and upon the collar clearance surface 52 radially aligning with the ball detents 38, the detents will radially move outwardly permitting the ball detents 38 to ride over the barrel end region 14. The cam collar 46 may then be released by the operator causing the cam 54 to engage the ball detents and bias the detents inwardly against the end region 14. Of course, inward movement of the ball detents is prevented by engagement of the balls with the barrel end region surface 14. Upon the detents 38 radially aligning with the barrel groove 16, the balls will "snap" into the groove 16 and the cam surface 54 will ride over the balls and the collar retainer surface 56 will now hold the ball detents in the groove 16 as shown in FIG. 2. In this manner, the adapter 22 is locked upon the gun barrel 10 with respect to relative axial movement, and the adapter is now fully mounted upon the gun barrel and the firearm may be operated as desired having the appropriate accessory, not shown, mounted upon the accessory mount 40.

When it is desired to remove the adapter 22 from the gun barrel 10, the operator merely grasps the cam collar 46 and moves the cam collar toward the accessory mount 40 to compress spring 60 and radially align the collar clearance surface 52 with the ball detents. The chamfer side 18 of the groove 16 will displace the detent balls outwardly, and the adapter may be quickly axially removed from the gun barrel. Release of the cam collar then permits the cam collar to bias the detent balls 38 inwardly against the lips 36 and the adapter 22 may be stored.

If it is desired that the adapter have a predetermined rotational orientation to the gun barrel 10, the key 20 will be located upon the firearm structure 11, and the adapter body 24 must be rotationally aligned with the key 20 when placing the adapter 22 on the gun barrel such that the key 20 may be received within the key recess 62 located within the body boss 28, as shown in FIG. 2.

Figure 3:
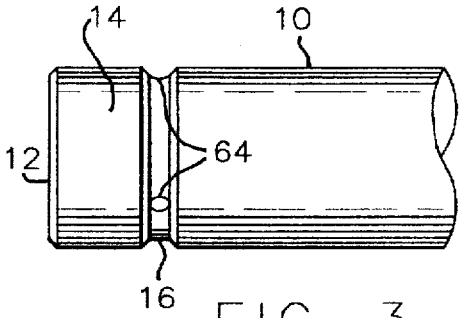
FIG. 3 is a detail elevational view of a gun barrel illustrating a groove having recesses defined therein.

Another way of rotationally orienting the adapter 22 to the gun barrel 10 is to form recesses 64 in the bottom of the groove 16 as shown in FIG. 3. In such event, the groove 16 will be dimensioned such that the cam collar 46 cannot move to its final locking position until the detent balls 38 are located within a recess 64. The recesses 64 will be circumferentially spaced apart a spacing equal to the circumferential spacing of the detent balls 38, and once the detent balls 38 are received within the groove 16, rotation of the adapter 22 will permit the detents to be received within recesses 64 permitting the cam collar to shift to its fully locked position as shown in FIG. 2, and the reception of the detent balls in the recesses 64 prevents relative rotation between the adapter and gun barrel.

Figure 4:
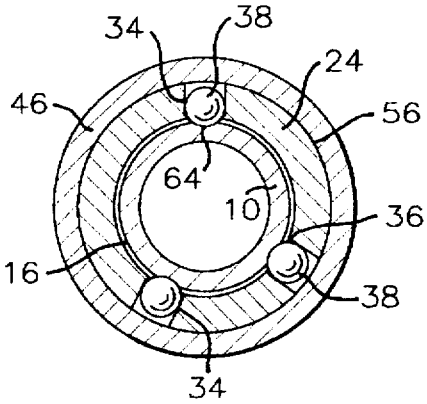
FIG. 4 is an elevational sectional view as if taken along Section 4—4 of FIG. 2 illustrating an adapter having detent balls asymmetrically related to each other for use with a groove having complementary asymmetrical recesses defined therein for rotatably positioning the adapter to the gun barrel in a predetermined location.

If it is desired that the adapter 22 be rotationally oriented to the gun barrel 10 in a single rotative relationship, such as achieved when using the keys 20 and 62, the detent balls 38 may be asymmetrically circumferentially spaced within the adapter body 24 as shown in FIG. 4. Likewise, the recesses 64 will be asymmetrically spaced in a circumferential direction within the groove 16 corresponding to the spacing of detents 38, and at only a single rotative position of the adapter 22 relative to the gun barrel 10 will permit the detent balls 38 to be received within the asymmetrically spaced recesses 64 assuring that the desired rotative position of the adapter on the gun barrel is achieved.

Figure 5:
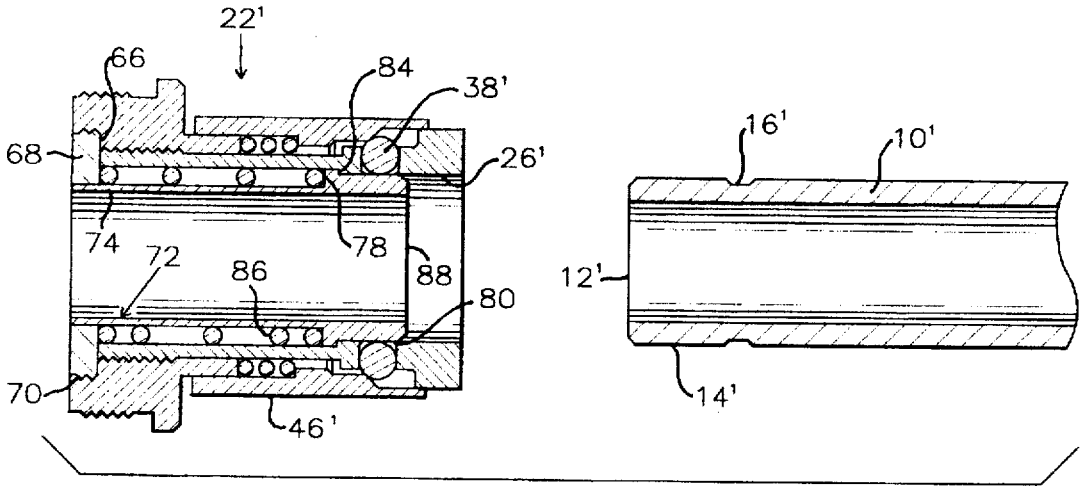
FIG. 5 is a diametrical sectional view of another embodiment of an adapter and gun barrel in axial relationship, and prior to assembly to each other wherein a ball detent retainer sleeve is located within the adapter bore.
Figure 6:
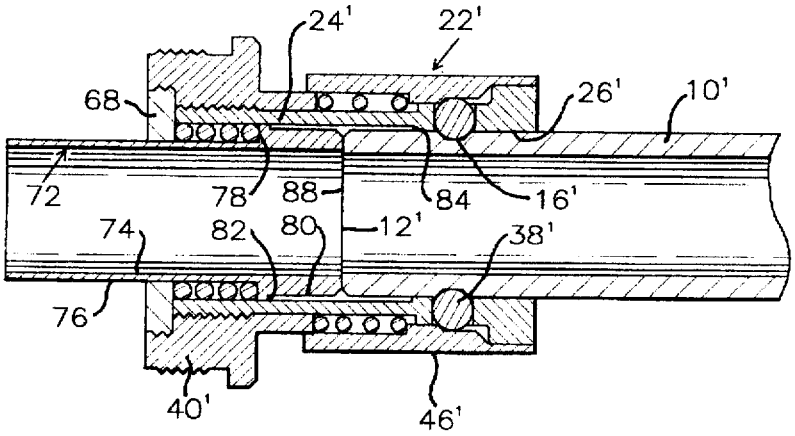
FIG. 6 is a diametrical sectional view illustrating the components shown in FIG. 5 in an assembled relationship wherein the adapter is locked upon the gun barrel.

An embodiment of the invention is shown in FIGS. 5 and 6 which simplifies the mounting of the adapter upon the gun barrel. In FIGS. 5 and 6, components identical to those previously described are indicated by primed reference numerals.

As appreciated from FIG. 5, the adapter 22' includes a cam collar 46' and ball detents 38' which operate in the general manner previously described. However, in this embodiment, the accessory mount 40' is countersunk at 66, and threaded, whereby an annular threaded plug 68 may be threaded into the countersink 66 through its threads 70. A ball detent retaining sleeve 72 is reciprocally mounted within the adapter bore 26', and the sleeve 72 includes a bore 74 which is of a diameter slightly greater than the gun barrel bore 13. The sleeve 72 includes a thin wall annular stem 76 and a radial shoulder 78. The annular ball retainer surface 80 defined upon the sleeve 72 is only slightly less in diameter than the adapter body bore 26' and a radial shoulder 82 defined upon the sleeve is adapted to engage the radial shoulder 84 formed in the adapter body 22'. An annular compression spring 86 is interposed between the plug 68 and the shoulder 78, and the spring 86 will impose a biasing force on the sleeve 72 toward the right as shown in FIGS. 5 and 6. In its unattached condition, as shown in FIG. 5, the sleeve 72 will be biased fully to the right engaging the shoulders 82 and 84. At this position, the sleeve surface 80 will be in radial alignment with the ball detents 38' holding the ball detents 38' out of the bore 26'. The cam collar 46' will be as shown in FIG. 5 wherein the cam surface will be engaging the ball detents 38' which are held against radial inward movement by the sleeve surface 80.

When mounting the adapter 22' on the gun barrel 10', the gun barrel end region 14' will enter the adapter bore 26' and engage the sleeve end 88. As the adapter is axially moved along the barrel end region 14', the sleeve will be displaced to the left, FIG. 6, compressing the spring 86 and the detent balls 38' will ride along the barrel end region 14' until they radially align with the barrel groove 16' into which they are received under the influence of the cam surface and spring of collar 46', and the mounting of the adapter 22' upon the gun barrel 10' is completed. If desired, the groove 16' may include recesses such as shown at 64 to prevent rotation of the adapter 22' relative to the gun barrel 10'.

When removing the adapter 22' from the gun barrel 10', the operator displaces the cam collar 46' in the manner identical to the embodiment of FIGS. 1–4. As the adapter 22' is moved to the left on the barrel end region 14', the barrel end 12' will remain in engagement with the sleeve end 88 and the ball detent retaining surface 80 of the sleeve will ride under the ball detents 38' and maintain the ball detents in their outer radial position as shown in FIG. 5.

Because the ball detent retracting or retaining sleeve 72 maintains the ball detents 38' in a retracted condition at all times except when the adapter is mounted upon the gun barrel, mounting of the adapter 22' on the gun barrel 10' merely requires inserting of the adapter upon the gun barrel and no manual operation of the cam collar 46' is initially required as is the case with the embodiment of FIGS. 1–4.

It is appreciated that various modifications to the inventive concepts may be apparent to those skilled in the art without departing from the spirit and scope of the invention.

I claim:

1. A system for mounting a firearm accessory upon a gun barrel comprising, in combination, a gun barrel having a cylindrical end region and an end, a detent depression annular groove defined in said end region spaced from said end, an accessory mounting adapter having a bore of a diameter to closely slidably receive said gun barrel end region, a detent mounted on said adapter radially movable between a first detent position clearing said adapter bore and a second detent position wherein said detent extends into said bore, and detent operating means mounted on said adapter permitting selective positioning of said detent between said detent positions whereby said detent may enter said gun barrel depression upon said detent being aligned with said depression, said detent operating means releasably maintaining said detent within said depression, said detent comprising a plurality of balls, each of said balls being mounted in said adapter for radial displacement therein, said detent operating means comprising a collar axially displaceable upon said adapter between first and second axial collar positions and a cam surface defined on said collar selectively engaging said detents, movement of said collar from said first collar position to said second collar position radially displacing and maintaining said detents at said second detent position, said balls being asymmetrically circumferentially spaced within said adapter, a plurality of recesses asymmetrically circumferentially located within said annular groove complementary in spacing and positioning to said balls whereby said balls will enter said recesses at only a single rotational position of said adapter upon said gun barrel.

2. A system for mounting a firearm accessory upon a gun barrel comprising, in combination, a gun barrel having a cylindrical end region and an end, a detent depression annular groove defined in said end region spaced from said end, an accessory mounting adapter having a bore of a diameter to closely slidably receive said gun barrel end region, a detent mounted on said adapter radially movable between a first detent position clearing said adapter bore and a second detent position wherein said detent extends into said bore, and detent operating means mounted on said adapter permitting selective positioning of said detent between said detent positions whereby said detent may enter said gun barrel depression upon said detent being aligned with said depression, said detent operating means releasably maintaining said detent within said depression, said detent comprising a plurality of balls, each of said balls being mounted in said adapter for radial displacement therein, said detent operating means comprising a collar axially displaceable upon said adapter between first and second axial collar positions and a cam surface defined on said collar selectively engaging said detents, movement of said collar from said first collar position to said second collar position radially displacing and maintaining said detents at said second detent position, a ball retractor displaceably located within said adapter bore selectively engaging and retracting said balls from said bore when said adapter is removed from said gun barrel, said retractor automatically releasing said balls upon inserting said adapter upon said gun barrel.

3. In a mounting system for a firearm accessory as in claim 2, said ball retractor comprising a tubular sleeve axially displaceably mounted within said adapter bore, a head defined on said sleeve, an abutment end defined on said sleeve adjacent said head engageable by said gun barrel end, and a spring axially biasing said sleeve toward said detent balls whereby said head will engage and maintain said ball detents radially retracted from said adapter bore when said adapter is removed from said gun barrel, and said sleeve abutment end is engaged by said barrel end when said adapter is inserted on said gun barrel to axially displace said sleeve and disengage said sleeve head from said detent balls.

4. A system for mounting a firearm accessory upon a gun barrel comprising, in combination, a gun barrel having a cylindrical end region and an end, an annular detent groove defined in said barrel end region axially spaced from said barrel end, an accessory mounting adapter having a bore of a diameter to closely slidably receive said gun barrel end region, a plurality of circumferentially spaced detent balls mounted on said adapter radially movable between a first detent position clearing said adapter bore and a second detent position extending into said bore, an annular collar axially displaceably mounted on said adapter positionable between first and second collar positions, a ball engageable cam defined on said collar engaging said ball detents at said collar second position radially displacing said balls to said second detent position and disengaging said detents at said first collar position, a first spring biasing said collar toward said second collar position, an annular ball detent retractor sleeve located within said adapter bore axially displaceable being first and second sleeve positions, a ball detent engaging surface defined on said sleeve engageable with said ball detents at said sleeve second position maintaining said detents in said first detent position, a second spring axially biasing said sleeve toward said second sleeve position, said sleeve being displaced from said second sleeve position to said first sleeve position wherein said sleeve surface disengages said ball detents by the gun barrel end upon said adapter being inserted upon said barrel end whereby said ball detents may enter said groove upon radial alignment of said ball detents therewith.

5. A system for mounting a firearm accessory upon a gun barrel as in claim 4, detent receiving recesses defined within said barrel groove whereby reception of said ball detents within said recesses prevents relative rotation between said adapter and said gun barrel.

6. A system for mounting a firearm accessory upon a gun barrel comprising, in combination, a gun barrel having a cylindrical end region and an end, a plurality of detent depressions defined in said end region spaced from said end, said depressions being asymmetrically circumferentially located about the gun barrel cylindrical end region, an accessory mounting adapter having a bore of a diameter to closely slidably receive said gun barrel end region, a plurality of detents mounted on said adapter radially movable between a first detent position clearing said adapter bore and a second detent position wherein said detent extends into said bore, said detents being asymmetrically circumferentially spaced with said adapter in a manner complemental to the asymmetrical spacing of the detent depressions, and detent operating means mounted on said adapter permitting selective positioning of said detents between said detent positions whereby said detents may enter said gun barrel depressions upon said detents being aligned with said depressions, said detent operating means releasably maintaining said detents within said depressions whereby said detents will enter said depressions at only a single rotational position of said adapter upon said gun barrel.

* * * * *